United States Patent [19]

Grumer

[11] Patent Number: 4,486,186

[45] Date of Patent: Dec. 4, 1984

[54] METHOD AND MACHINE FOR MAKING FILTER ROD SECTIONS FOR CIGARETTES OR THE LIKE

[75] Inventor: Peter Grumer, Tespe, Fed. Rep. of Germany

[73] Assignee: Hauni-Werke Körber & Co. KG, Hamburg, Fed. Rep. of Germany

[21] Appl. No.: 393,495

[22] Filed: Jun. 29, 1982

[30] Foreign Application Priority Data

Jul. 15, 1981 [DE] Fed. Rep. of Germany ..... 3127911

[51] Int. Cl.[3] ..... A24C 5/50

[52] U.S. Cl. ..... 493/4; 242/131; 493/9; 493/16; 493/24; 493/45; 493/49

[58] Field of Search ..... 493/4, 44, 45, 42, 49, 493/50, 39, 9, 16, 24; 242/131, 130

[56] References Cited

U.S. PATENT DOCUMENTS

| | | | |
|---|---|---|---|
| 1,459,694 | 6/1923 | Reiners | 242/130 |
| 3,818,809 | 6/1974 | Sylvester | 493/4 |
| 3,971,695 | 7/1976 | Block | 493/4 X |
| 3,974,007 | 8/1976 | Greve | 493/49 X |
| 4,175,479 | 11/1979 | Roullier | 493/4 |
| 4,283,998 | 8/1981 | Greve et al. | 493/4 |
| 4,396,168 | 8/1983 | Hilt et al. | 242/130 |

*Primary Examiner*—James F. Coan
*Attorney, Agent, or Firm*—Peter K. Kontler

[57] ABSTRACT

The trailing end of a running tow of filamentary filter material in a filter rod making machine is spliced to the leader of a fresh tow, and the splice is held at a preselected location ahead of the first tow treating station in the machine. An optoelectric or pressure-responsive detector generates a signal when the splice advances beyond such location on expiry of the running tow, i.e., when the second tow begins to advance through the machine. The signal is used to reduce the speed of the prime mover of the machine during travel of the splice therethrough, to increase the width of passages which are defined for the tow by the banding, spreading, stretching, plasticizer-applying and/or other units for the tow so that the splice can readily advance therethrough, and/or to effect automatic segregation of those filter rod sections which contain portions of the splice.

38 Claims, 3 Drawing Figures

Fig.1

METHOD AND MACHINE FOR MAKING FILTER ROD SECTIONS FOR CIGARETTES OR THE LIKE

BACKGROUND OF THE INVENTION

The present invention relates to a method and apparatus for making filter mouthpieces or filter plugs, and more particularly to improvements in a method and in a machine for the production of filter rod sections which can be used in filter tipping or analogous machines for mass-production of filter cigarettes, cigars or cigarillos.

Filter rod sections are obtained by subdividing a continuous filter rod which normally contains a rod-like filler of fibrous filter material and a tubular envelope consisting of cigarette paper, imitation cork or other flexible wrapping material draped around the filler. The filler is formed by advancing a so-called tow of filamentary filter material (e.g., acetate fibers) through several processing stations, such as one or more banding stations where the normally crimped filaments are separated (disentangled) from one another, a stretching station where the filaments are stretched to reduce, eliminate or uniformize the crimp, a spreading station where the filaments are spread apart to form a thin layer, a station where the filaments of the layer are contacted by a finely atomized liquid plasticizer, and a gathering station where the layer is converted into a rod-like cylindrical body or filler. Such filler is thereupon draped into a web of cigarette paper or the like, and the resulting continuous filter rod is severed by a suitable cutoff to yield a succession of discrete filter rod sections of desired length, e.g., six or eight times unit length.

As a rule, the tow is supplied in the form of a bale wherein the tow is looped back and forth and is condensed so that the bulk of the bale is reduced to a minimum without unduly affecting the quality of the filamentary filter material. In order to avoid the need for a stoppage of the filter rod making machine when a supply (bale) of running tow is exhausted, the trailing end of the running tow is normally spliced to the leader of the next-following (fresh) tow so that the making of the filler can proceed without interruptions. This is highly desirable because the threading of the leader of a fresh tow through the filter rod making machine is a time-consuming operation, i.e., each such threading entails substantial losses in output, especially in a modern filter rod maker which can turn out many thousands of filter plugs per minute. The splice between two successive tows is formed by welding or by otherwise bonding the trailing end of the running tow to the leader of the fresh tow. To this end, the trailing end is placed over the leader or vice versa, i.e., the thickness of the splice exceeds the thickness of a single tow. Moreover, such splice constitutes a non-homogeneous portion of the composite tow, i.e., the characteristics of filter plugs which contain portions of a splice deviate from the characteristics of other (acceptable) filter plugs so that it is highly desirable to segregate from a production line (including, for example, one or more filter rod making machines, one or more cigarette rod making machines, one or more filter tipping machines and one or more packing machines) all such filter rod sections which contain portions of or entire splices. As a rule, the density of the filler in a filter rod section which contains a portion of or an entire splice is likely to be higher than desirable since the cross-section of the splice must be reduced to the cross-section of the filler which is obtained from a running tow. Moreover, welding of the leader of the next-following tow to the trailing end or portion of the preceding (expired or expiring) tow is likely to result in hardening of the respective portion of the filler so that it might affect the integrity of the envelope, for example, by causing the seam between the overlapping marginal portions of the web of wrapping material to open. This means that the corresponding filter cigarettes, cigars or cigarillos must be segregated from satisfactory smokers' products with attendant losses in tobacco.

The formation of a splice which is, or which is likely to be, harder than the normal filler of a filter rod can cause other problems in a modern high-speed filter rod making machine. Thus, the width of various clearances (such as gaps between the elements of so-called tow banding devices, the width of nips of advancing, stretching and spreading rolls for the tow, and the width of the passage at the plasticizer applying station) is normally selected with a view to ensure the making of an optimum filler from a tow of normal thickness and hardness, i.e., the width of such clearances may not suffice to allow for unimpeded passage of a splice. The situation is aggravated in a modern filter rod maker wherein the tow is transported at a high or extremely high speed in order to ensure that the filter rod making machine can meet the requirements of a modern high-speed filter tipping or like machine. Therefore, a splice is likely to be caught in the banding, spreading, stretching and/or plasticizer-applying unit or units of the machine, and this can lead to damage to component parts of the machine and/or to breaking or tearing of the tow with attendant losses in output which are occasioned by the need to thread the leader of the tow behind the break through the filter rod making machine.

In accordance with heretofore known proposals, the speed of the filter rod making machine is reduced whenever a splice is about to be transported therethrough. This is less likely to result in breakage of the tow because the splice can pass more readily through the afore-enumerated stations if its speed is less than the nominal or normal operating speed. The speed of the prime mover is reduced by hand, and the attendant observes the progress of the splice through the machine so that the speed of the prime mover can be increased back to normal as quickly as possible after the splice has been advanced through the machine. However, even though such mode of manipulating the machine reduces the likelihood of breakage of the web, it does not prevent the defective or less satisfactory filter rod sections (namely, those sections which contain the splices or portions of the splices) from reaching the next machine or machines of the production line, i.e., such filter rod sections will contribute to the making of defective smokers' products. If not detected, the defective smokers' products will constitute an annoyance to the purchaser. Alternatively, such defective filter rod sections must be detected by resort to complex and sensitive testing equipment so as to prevent their entry into the next machine, such as a filter tipping machine.

OBJECTS AND SUMMARY OF THE INVENTION

An object of the invention is to provide a novel and improved method of preventing the splices between successive tows of filamentary filter material from adversely influencing the operation of a filter rod making machine.

Another object of the invention is to provide a method which ensures that all such filter rod sections which contain portions of or entire splices cannot advance beyond the filter rod making machine together with the satisfactory filter rod sections.

A further object of the invention is to provide a method which reduces the likelihood of breakage of the tow during transport of a splice through a filter rod making machine.

An additional object of the invention is to provide a method which reduces the likelihood of damage to the component parts of a filter rod making machine during transport of a splice and which reduces the likelihood of losses in output as a result of transport of the splice through the machine.

Another object of the invention is to provide a novel and improved method of automatically segregating from satisfactory filter rod sections all such filter rod sections which contain, or are likely to contain, portions of splices.

A further object of the invention is to provide a method which prevents unintentional stoppage of the tow in its path through a filter rod making or like machine.

An additional object of the invention is to provide a method of automatically conforming the width of various portions of the path for a filter tow in a filter rod making machine to fluctuations in the thickness and/or hardness of the tow.

Another object of the invention is to provide a filter rod making machine which is designed for the practice of the above outlined method.

An additional object of the invention is to provide a filter rod making machine with novel and improved means for automatically segregating from satisfactory filter rod sections all such filter rod sections which contain tow portions that do not measure up to the prescribed norm.

A further object of the invention is to provide a filter rod making machine wherein the splice between two successive tows of filamentary filter material cannot be caught in one or more processing units even if the thickness and/or density of the splice greatly exceeds the thickness and/or density of an average tow.

A further object of the invention is to provide a filter rod making machine wherein a splice can be advanced through various processing units without any attention on the part of the workers and without causing undesirable stoppage and/or tearing of the running tow.

Another object of the invention is to provide the filter rod making machine with novel and improved means for adjusting one or more tow treating units preparatory to and/or during transport of a splice between successive tows through the machine.

Still another object of the invention is to provide novel and improved means for monitoring the position of a connection between successive tows in a filter rod making or like machine.

An additional object of the invention is to provide the filter rod making machine with novel and improved means for simultaneously or successively adjusting several tow processing or treating units during passage of a splice through the machine.

Another object of the invention is to provide a filter rod making machine whose output is higher than that of heretofore known machines and which requires less attention than conventional machines.

Another object of the invention is to provide a filter rod making machine which automatically prevents filter rod sections having unsatisfactory fillers from reaching the next processing unit or machine.

A further object of the invention is to provide a filter rod making machine wherein the fact that successive tows of a series of successive tows are bonded or otherwise connected to one another need not entail any losses other than the expulsion or segregation of that filter rod section or those filter rod sections which contains or contain portions of or the entire connection.

One feature of the invention resides in the provision of a method of making filter rod sections for incorporation into smokers' products, such as filter cigarettes, cigarillos or cigars. The method comprises the steps of establishing and maintaining first and second courses (e.g., bales) which respectively contain first and second tows consisting of filamentary filter material and each having a leader or front end portion and a trailing end or rear end portion, subjecting the first tow to a plurality of treatments including advancing the first tow along a predetermined path and processing the first tow in several portions of the path, making between the trailing end of the first tow and the leader of the second tow a splice which is set in motion on expiry of the first tow and the resulting advancement of the second tow along the path, and altering at least one of the treatments in automatic response to movement of the splice, i.e., when the splice is set in motion on expiry of the first tow.

The method preferably further comprises the steps of maintaining the splice in a predetermined position which the splice abandons on expiry of the first tow, generating a signal in response to movement of the splice beyond the predetermined position, and utilizing the signal to alter the one treatment. The latter can include advancing the tow along the path, banding the tow in the path, stretching the filaments of the tow, applying a suitable atmoized plasticizer to the filaments of the tow in the path and/or expelling or segregating from the path those portions of the tow which contain the splice.

More specifically, the processing can include converting the tow and a web of wrapping material into a continuous rod and subdividing the continuous rod into a succession of discrete filter rod sections; the one treatment can include segregating from the just mentioned succession all such filter rod sections which contain portions of the splice.

The advancing step can include transporting the tow at at least one first speed, and the one treatment can include reducing the first speed to a lower second speed, at least during a portion of that interval which elapses during advancement of the splice along the path.

The path can have at least one portion of variable width, and the one treatment can include increasing the width of the one path portion so as to allow for at least substantially unobstructed passage of the splice therethrough. Alternatively, the path can have several portions of variable width, and the one treatment can include increasing the width of each such portion of variable width so as to allow for at least substantially unobstructed passage of the splice therethrough. The width of all such portions of the path can be increased simultaneously or one after the other, as soon as the splice approaches a portion of variable width.

As a rule, the processing will involve treating the tow at each of a series of successive stations which are adjacent to successive portions of the path. The method can further comprise the aforementioned steps of maintaining the splice in a predetermined position which the splice abandons on expiry of the first tow, generating a signal in automatic response to movement of the splice away from the predetermined position, and utilizing the signal to alter the one treatment, preferably to alter the treatment of the tow seriatim at successive stations in at least substantial synchronism with advancement of the splice from the predetermined position toward the respective (successive) portions of the path. The signal can be maintained during the interval of advancement of the splice from the predetermined position to the last of the succession of stations. In addition, the utilizing step can include the aforementioned step of reducing the speed at which the tow advances along the path during movement of the splice from the predetermined position to the last of the series or succession of stations.

Another feature of the invention resides in the provision of a machine which turns out filter rod sections for incorporation into or for assembly with tobacco-containing articles to form rod-shaped smokers' products. The machine comprises first and second sources (e.g., discrete bales) which respectively contain first and second tows consisting of filamentary filter material and each having a leader and a trailing end whereby the leader of the second tow and the trailing end of the first tow form a splice, a plurality of tow treating units including a variable-speed prime mover or other suitable drive means for advancing the first tow along a predetermined path and additional units (such as one or more tow banding devices, a tow stretching device, a tow spreading device, a device which sprinkles atomized plasticizer onto the filaments of the tow, a gathering device which converts a flat tow into a rod-like filler, a device which drapes the filler into a web of suitable wrapping material to thus form a continuous filter rod, a device for subdividing the continuous rod into a file of discrete filter rod sections which move axially, a device which converts the file of discrete filter rod sections into one or more rows wherein the filter rod sections move sideways, and/or others) for treating the tow in the path, monitoring means for generating a signal when the splice between the first and second tows is set in motion on expiry of the first tow, and means for changing the condition of at least one unit in response to the signal. The aforementioned units include a foremost unit (namely, a unit which can be said to be nearest to the monitoring means), as considered in the direction of advancement of the tow along its path, and the monitoring means is located ahead of such foremost unit.

The machine can further comprise means for holding the splice between the tows at a predetermined location which the splice abandons on expiry of the first tow. In such a machine, the monitoring means comprises or can comprise detector means for generating the signal in response to advancement of the splice from the predetermined location. The holding means is preferably designed to yieldably (i.e., releasably) retain the splice at the predetermined location. The detector means of the monitoring means can comprise optoelectronic transducer means, a pressure-responsive sensor or any other detector means which can generate an appropriate signal in response to advancement of the splice beyond the predetermined location. For example, the aforementioned holding means can include a support whereon the splice is held by suction at the predetermined location and which the splice abandons on expiry of the first tow. The detector means generates the signal as soon as the splice leaves the locus where it is held by suction prior to expiry of the first tow. The holding means can include a support for the splice and the support can have one or more suction ports which are connected with a suitable suction generating device and normally attract the splice to the support so that the splice can advance in automatic response to expiry of the first tow, i.e., when the advancing unit of the machine begins to advance the second tow along the aforementioned path. The detector means can constitute a pressure-sensitive detector which is installed in a suction port or opening of the support.

Alternatively, the machine can comprise mechanical holding means for yieldably retaining the splice at the predetermined location. The detector of the monitoring means is designed to generate the signal in response to advancement of the splice beyond the mechanical holding means. The detector means can include an electric switch which is opened or closed by a portion of the mechanical holding means when the splice is set in motion to advance toward the foremost unit of the machine. For example, the mechanical holding means can include a pivotable lever or arm which is biased against the splice but yields when the splice is advanced toward the foremost unit of the machine whereby a portion (e.g., an extension) of the lever or arm trips the switch to initiate the generation of the signal.

At least the one unit of the machine can define in the respective portion of the path a passage of variable width, and the aforementioned changing means (e.g., one or more amplifiers, electromagnets, servomotors or analogous actuators) includes means for varying the width of the passage in response to the signal, preferably means for increasing the width of the passage so as to allow for at least substantially unimpeded advancement of the splice through and beyond the passage. Several additional units of the machine can define passages of variable width, and the changing means then includes or can include means for varying the width of each such passage to thus even further reduce the likelihood of breakage of the tow and/or stoppage of the tow as a result of engagement with the part or parts of a unit whose passage is wide enough for the advancement of the tow but not for the advancement of the relatively thick and/or relatively hard splice.

The advancing means can include variable-speed drive means for the tow in the path, and the changing means can include means for varying the speed of the drive means in response to the signal, preferably for reducing the speed below the normal or average speed so as to further reduce the likelihood of damage to the tow and/or machine during advancement of the splice through and/or along various units which may but need not always be adjusted (at such time) for the passage or advancement of the splice therethrough or therealong.

The aforementioned unit which converts the file of discrete rod-shaped filter sections into one or more rows of filter rod sections can be said to constitute a means for transporting the filter rod sections along a predetermined portion of the path for the tow. The one unit of the machine can include a normally idle ejecting or expelling device for filter rod sections in the predetermined portion of the path, and the changing means then comprises means (e.g., a servomotor or a switch) for activating the ejecting device in response to the signal, preferably for an interval of time which suffices to ensure the ejection of each and every filter rod section which is likely to contain a part of the splice. The ejecting device can comprise a nozzle whose orifice or orifices are directed against the filter rod sections in the predetermined portion of the path, a source of compressed gaseous fluid, conduit means connecting the source with the nozzle, and normally closed valve means in the conduit means. The changing means then comprises means for temporarily opening the valve means during advancement of those filter rod sections (past the orifice or orifices of the nozzle) which contain or are likely to contain portions of the splice.

The machine can further comprise means for delaying the application or transmission of the signal to the changing or actuating means so as to account for the interval of advancement of the splice toward the one unit, e.g., for an interval of time which elapses while the splice advances from its predetermined location to the foremost unit of the machine. The delaying means can be designedor adjusted in such a way that the delayed signal causes the changing means to alter the condition of the one unit only immediately prior to and during advancement of the splice through the respective portion of the path.

In addition to its aforedescribed functions, the changing means can be designed to reduce the speed of the tow, to increase the width of one or more passages and/or to initiate the ejection or segregation of defective or potentially defective filter rod sections during the interval of generation and maintenance of the signal.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3:
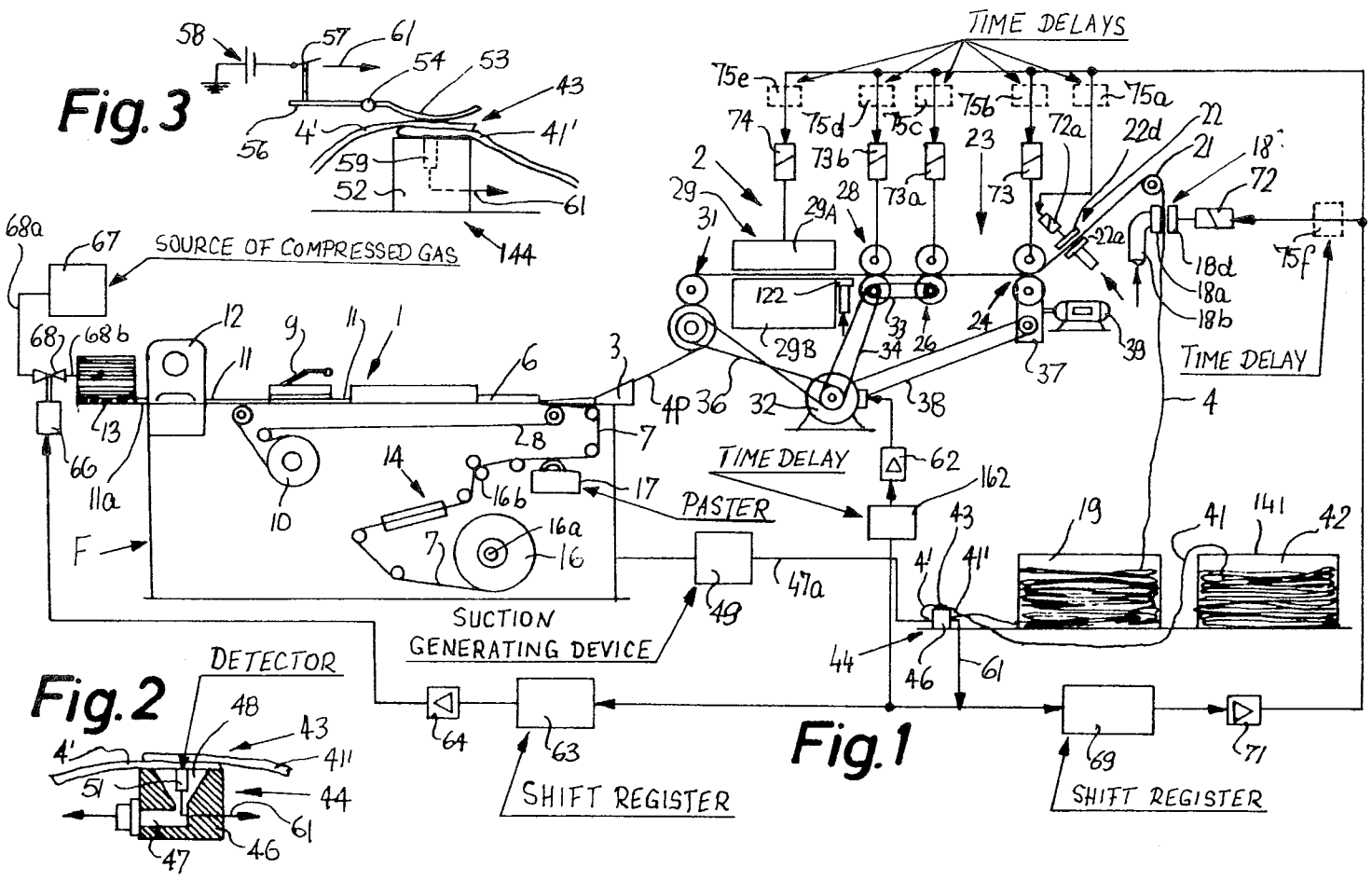
FIG. 1 is a somewhat schematic elevational view of a filter rod making machine which embodies one form of the present invention and wherein the splice between two tows of filamentary filter material is held in a predetermined position preparatory to advancement through the machine.
FIG. 2 is an enlarged sectional view of the monitoring means which is used in the machine of FIG. 1 to detect the removal and advancement of the splice from its predetermined position.
FIG. 3 is an elevational view of a modified monitoring means which can be used in lieu of the monitoring means shown in FIG. 2.

Referring first to FIG. 1, there is shown a filter rod making machine which comprises two main sections including a section 1 and a section 2. The section 2 serves to process or treat successive tows 4 and 41 of filamentary filter material preparatory to conversion of such tows into a continuous filler which is thereupon processed in the section 2 to form part of a continuous filter rod 11.

The section 1 comprises a frame F which carries a so-called gathering horn 3 serving to convert a flat processed tow 4P into a substantially rod-like filler and to direct such filler into a wrapping mechanism or unit 6 wherein the filler is draped into a continuous web 7 of cigarette paper, imitation cork or a like flexible wrapping material. The web 7 is caused to advance through the wrapping mechanism 6 by an endless flexible belt conveyor 8 (also called garniture tape) the upper reach of which advances the continuous filter rod 11 past a heating or cooling device 9 (depending upon whether the adhesive which at least partially coats one side of the web 7 is a wet adhesive or a hotmelt). The device 9 heats or cools the seam which is formed by the overlapping marginal portions of the web 7 during transport through the wrapping mechanism 6. The belt conveyor 8 is driven by a pulley 10. Successive increments of the filter rod 11 enter a so-called cutoff 12 which subdivides the rod 11 into a succession of discrete filter rod sections **11*a*. Successive sections 11*a* (each of which may be of six or eight times unit length) are propelled into successive axially parallel peripheral flutes of a rotary drum-shaped row-forming conveyor 13 which converts the single file of sections 11*a* advancing beyond the cutoff 12 into one or more rows of parallel sections 11*a*** which advance sideways, i.e., at right angles to their respective longitudinal axes.

The frame F further supports a driven spindle **16*a* for a reel 16 of convoluted web 7. Such web is advanced by a pair of advancing rolls 16*b* and advances through a guide 14 before reaching a paster 17 which coats one side of the web with a suitable adhesive before the web reaches the upper stretch of the belt conveyor 8 downstream of the gathering horn 3**.

The filter rod sections **11*a* which are transported by the conveyor 13 can be delivered to the magazine of a filter tipping machine wherein such sections are assembled with plain cigarettes, cigars or cigarillos to form therewith filter cigarettes, cigars or cigarillos of unit length or multiple unit length. For example, the filter rod sections 11*a*** can be delivered to the magazine of a filter tipping machine known as MAX-S which is manufactured and sold by the assignee of the present application. Reference may be had to commonly owned U.S. Pat. No. 4,281,670 granted Aug. 4, 1981 to Uwe Heitmann et al. which describes and shows a MAX-S filter tipping machine.

The section 2 of the filter rod making machine shown in FIG. 1 comprises a first source 19 of tow 4 and a second source 42 of tow 41. Each of the sources 19, 42 preferably contains a highly condensed bale of filamentary filter material, and the tow 4 which is supplied by the source 19 is caused to advance along a predetermined path extending through a first banding device 18 (first or foremost treating or processing unit) having a nozzle **18*a* which receives compressed air from a source (not shown) through a supply conduit 18*b* and directs minute streams or jets of compressed air through the running tow 4 and against an adjustable plate-like abutment member 18*d* which is movable toward and away from the nozzle 18*b* by an actuating or condition changing means here shown as an electromagnet 72. Successive increments of the running tow 4 thereupon travel around a guide roll 21 and pass through a second banding device 22 which is analogous to the banding device 18. The abutment 22*d* of the second banding device 22 is movable toward and away from the nozzle 22*a* of the banding device 22 by a second electromagnet 72*a*. Successive increments of the running tow 4 thereupon advance through the passage or nip of two cooperating rolls 24 which constitute a means for braking the tow so as to stretch the tow between the just mentioned nip and the passage or nip of a second pair of rolls 26 the peripheral speed of which normally exceeds that of the rolls 24. The reference character 23 denotes a stretching or expanding station which is disposed between the nips of the pairs of rolls 24 and 26. The filaments of the tow 4 exhibit a tendency to curl, and the purpose of the rolls 24 and 26 is to reduce or eliminate the crimp of the filaments before the respective increments of the tow 4 advance into, through and beyond the passage or nip of an additional pair of advancing rolls 28 which are located upstream of a station 29 for the application of an atomized plasticizer (such as triacetin) to the filaments of the stretched and flattened tow 4. The thus treated tow 4 constitutes a wide layer wherein all or nearly all of the filaments are disposed in a common plane. Such layer or tow 4P is thereupon caused to travel around a pair of deflecting rolls 31 prior to entering the inlet of the gathering horn 3. The purpose of the banding devices 18 and 22 is to disentangle or separate the normally interlaced filaments of the running tow 4 before the tow is stretched at the station 23 between the pairs of rolls 24 and 26. The rolls 28 effect a spreading action to further increase the likelihood that droplets of atomized plasticizer at the station 29 will come into contact with each and every filament of the properly banded, stretched and expanded tow. A further banding device 122 can be installed adjacent to the path of the running tow 4 immediately upstream of the plasticizer-applying station 29. The details of the unit at the plasticizer-applying station 29** can be identical with those of the unit which is described and shown in commonly owned U.S. Pat. No. 4,313,974 granted Feb. 2, 1982 to Heinz Greve et al. The disclosure of this patent is incorporated herein by reference. The same holds true for commonly owned U.S. Pat. No. 3,971,695 granted July 27, 1976 to Hans-Jürgen Block.

The filter rod making machine further comprises a drive means or main prime mover 32 (for example, a variable-speed electric motor) which drives a first chain transmission 34 for the lower roll 28, a second chain transmission 33 which receives motion from the lower roll 28 and drives the lower roll 26, a third chain transmission 38 which drives the rotary input element of a gear transmission 37 whose ratio can be varied by an electric motor 39, and a belt transmission 36 which drives the lower roll 31. The prime mover 32 further drives the pulley 10 for the belt conveyor 8 in a manner which is not specifically shown in FIG. 1.

In order to avoid the need for an interruption of operation of the filter rod making machine including the sections 1 and 2, the trailing end 4' of the running tow 4 is spliced (for example, by welding) to the leader 41' of the tow 41 which is stored in the form of a bale 41 confined in a receptacle 141. The splice 43 rests on or is otherwise operatively associated with the housing or support 46 of a monitoring device 44, for example a device having a detector 51 of the type illustrated in greater detail in FIG. 2.

Referring now to FIG. 2, the connection or splice 43 between the trailing end 4' of the tow 4 and the leader 41' of the tow 41 rests on the housing 46 which has a suction intake or bore 47 connected by a conduit 47a to a suction generating device 49 (see FIG. 1) preferably serving to simultaneously generate subatmospheric pressure in certain other parts of the filter rod making machine in a manner and for the purposes well known from the art. The suction intake 47 communicates with an upwardly expanding or diverging suction port 48 which is overlapped by the splice 43 so that the latter normally occludes the light-sensitive surface of a photoelectronic transducer constituting the detector 51 in the suction port 48. The transducer 51 constitutes but one form of detector or sensor means which can be utilized in the monitoring device 44 to detect the shifting or advancement of the splice 43 beyond the suction port 48, namely, beyond a predetermined location or position where the splice is normally held as long as the source 19 still contains a supply of the running tow 4. For example, the optoelectronic transducer 51 of FIG. 2 can be replaced with a pressure-responsive sensor of any known design which should be capable of generating an electronic signal via conductor means 61 as soon as the splice 43 is moved away from the upper end of the suction port 48. The illustrated transducer 51 can be disposed at a level below a source of light so that the latter can direct a light beam against the light-sensitive surface of the transducer 51 as soon as the splice 43 is moved away from the housing 46 in response to expiry of the tow 4.

FIG. 3 illustrates a modified monitoring device 144 which comprises a body member 52 serving as a support for the splice 43 between the trailing or rear end 4' of the running tow 4 and the leader 41' of the fresh tow 41. A mechanical holding device or finger 53 is pivotable at 54 and releasably or yieldably bears against the splice 43 (e.g., by gravity and/or under the bias of one or more springs, not shown) so as to urge the splice against the upper side or surface of the support 52. The mechanical holding device 53 has an extension 56 which constitutes an actuator or trip for an electric switch 57 serving to transmit a signal to conductor means 61 as soon as the switch 57 is closed in response to pivoting of the holder 53 as a result of removal of the splice 43 from the predetermined position or location shown in FIG. 3. When the switch 57 is closed in response to removal of the splice 43 from the position of FIG. 3, it connects a source of electrical energy 58 with the conductor means 61 so that the latter can transmit signals to various components of the electric circuit which is shown in FIG. 1.

If desired, the switch 57, energy source 58 and mechanical holder 53 can be replaced by a photoelectronic transducer 59 which is installed in the support 52 and is indicated in FIG. 3 by broken lines. The output of the transducer 59 can transmit a signal to conductor means 61 (also indicated in FIG. 3 by broken lines) in response to removal of the splice 43 from the top surface of the support 52. As mentioned in connection with the monitoring device 44 shown in FIG. 2, the photoelectronic transducer 59 can be replaced with a pressure-responsive sensor of any known design without departing from the spirit of the invention.

The conductor means 61 is connected with the output of the detector 51, 57 or 59 and transmits a signal whenever the splice 43 leaves its normal or predetermined position. The signal which is transmitted by the output of the selected sensor or detector is transmitted to an amplifier 62 for the circuit of the prime mover 32. The purpose of transmission of a signal to the amplifier 62 is to cause the latter to reduce the speed of the output element of the prime mover 32 not earlier than when the splice 43 between the tows 4 and 41 leaves its predetermined position with reference to the monitoring device 44 or 144.

The signal which is transmitted by the conductor means 61 is further applied to the input of a time-delay device 63 the output of which transmits signals to an amplifier 64 for a servomotor 66 serving to actuate a solenoid-operated valve 68 in a conduit 68*a* receiving compressed gaseous fluid (preferably air) from a suitable source 67. The conduit 68*a* is designed to supply compressed air to an ejector nozzle 68*b* which is adjacent to the periphery of the drum-shaped conveyor 13 and serves to expel from the flutes of the conveyor 13 a certain number of filter rod sections 11*a*, for example, a single filter rod section which happens to contain the splice 43. Alternatively, the ejector nozzle 68*b* can expel from the flutes of the conveyor 13 all such filter rod sections 11*a* which are formed subsequent to generation of a signal by the detector 51, 57 or 59 and until such time when the splice 43 reaches the expelling or ejecting station accommodating the nozzle 68*b*. The time-delay element 63 may constitute a shift register whose stages transport the signal from the conductor means 61 to the amplifier 64 in imitation of advancement of the splice 43 from the monitoring device 44 or 144 to the ejecting station accommodating the nozzle 68*b*.

The conductor means 61 is further connected to the input of a time-delay device 69 which can constitute a second shift register and whose output transmits delayed signals to an amplifier 71. The output of the amplifier transmits such signals to the aforementioned electromagnets 72 and 72*a* for the adjustable elements 18*d* and 22*d* of the respective banding devices 18 and 22. The purpose of the electromagnets 72 and 72*a* is to influence the width of passages between the nozzle 18*a* and the element 18*d* of the banding device 18 and the width of the passage between the nozzle 22*a* and element 22*d* of the banding device 22. The output of the amplifier 71 is further connected with electromagnets 73, 73*a* and 73*b* as well as with a further electromagnet 74. The electromagnet 73 can increase the width of the passage or nip between the rolls 24, the electromagnet 73*a* can increase the width of the passage or nip of the rolls 26, the electromagnet 73*b* can increase the width of the passage or nip of the rolls 28, and the electromagnet 74 can increase the width of the passage for the tow 4 or 41 between the upper and lower sections 29A and 29B of the unit which applies atomized plasticizer to successive increments of the banded, stretched and spread-out tow advancing from the rolls 28 toward the rolls 31.

The operation of the machine which is shown in FIG. 1 is as follows:

The running web 4 is drawn from the bale 19 by the rolls 24 so that it advances through the passage between the elements 18*a*, 18*b* of the first banding device 18, around the guide roll 21, through the passage between the elements 22*a*, 22*d* of the second banding device 22, through the nip of the rolls 24, through the nip of the rolls 26, through the nip of the rolls 28, through the third banding device 122, and through the plasticizer applying station 29 on its way toward the rolls 31 and thence into the gathering horn 3. The banding devices 18, 22 and 122 ensure that the filaments of the running tow 4 are disentangled from one another so that they can be properly stretched at the station 23 and properly sprinkled with minute droplets of plasticizer during travel through the station 29. The purpose of the rolls 28 is to further flatten or expand the running tow so as to further reduce the likelihood that some of the filaments would receive less plasticizer than the remaining filaments. In normal operation of the machine which is shown in FIG. 1, the width of the passages defined by the elements 18*a*, 18*b* of the banding device 18 and of the elements 22*a*, 22*d* of the banding device 22 is just sufficient to allow the tow 4 to pass therebetween. The same holds true for the passages or nips of the rolls 24, 26 and 28 and for the passage between the elements of the third banding device 122. Also, the width of the passage between the upper and lower sections 29A, 29B of the device serving to apply atomized plasticizer at the station 29 is just sufficient to allow the tow 4 to pass therethrough. In other words, the width of the just discussed passages is sufficient to allow for unimpeded advancement of the tow 4 but is or might be likely to interfere with proper advancement of an enlarged or thickened portion such as the splice 43 between the trailing end 4' of the running or expiring tow 4 and the leader 41' of the fresh tow 41. Successive increments of the properly treated tow 4P are converted into a rod-like filler during travel through the gathering horn 3 of the section 1, and the filler is thereupon directed onto the upper reach of the belt conveyor 8 so as to form with the running web 7 a continuous filter rod 11 as a result of advancement through the wrapping mechanism 6. The seam of the wrapper of the rod 11 is thereupon heated or cooled by the device 9 before the rod 11 is severed by the cutoff 12 to yield a single file of discrete filter rod sections 11*a* which are propelled into successive axially parallel peripheral flutes of the rotary drum-shaped conveyor 13. The row or rows of filter rod sections 11*a* move sideways and are delivered to the magazine or magazines of one or more processing machines, preferably to one or more filter tipping machines.

In order to ensure that the splice 43 at the trailing end 4' of the expiring or running tow 4 cannot cause disturbances in the operation of the filter rod making machine, for example, a breakage of the tow 4 and/or of next-following tow 41 in the region of or behind the splice 43, the detector of the monitoring device 44 or 144 generates a signal in the aforedescribed manner as soon as the splice 43 moves beyond the station or location accommodating the monitoring device. Prevention of breakage or tearing of the running tow reduces the down times of the filter rod making machine because it obviates the need for threading the next-following tow through the machine in response or subsequent to a breakage. The making of the splice 43 can take place at any time prior to expiry of the running tow 4. For example, such splice can be formed as soon as a fresh supply of tow (i.e., a fresh bale) is admitted to the station for the source 42. This ensures that the splice 43 is always ready when the supply of running tow expires. When the tow 41 expires, its trailing end is already connected to the leader of a fresh tow which is disposed at the station 19, and the same procedure is then repeated in a manner to be described hereinafter, namely, so that the travel of a splice through the machine of FIG. 1 does not cause a break in the running tow and/or improper operation of or damage to certain components of the filter rod making machine.

When the tow 4 is about to expire or has expired, the splice 43 is entrained by the prime mover 32 through the intermediary of the rolls 24 so that it advances toward the passage between the elements 18*a* and 18*d* of the foremost processing unit, namely, the first banding device 18. The removal or shifting of the splice 43 from its predetermined location causes the selected detector 51, 57 or 59 to transmit a signal via conductor means 61 with the result that the speed of the prime mover 32 is immediately reduced via amplifier 62. In the embodiment of FIG. 2, the splice 43 is normally attracted to the housing 46 by suction in the port 48. In the embodiment of FIG. 3, the splice 43 is releasably urged against the top surface of the body member 52 by the mechanical holding device 53. The attracting or retaining action is selected in such a way that it cannot cause excessive tensional stressing of component parts of the splice 43 and/or of the next-following fresh tow 41.

A reduction in the speed of the prime mover 32 in immediate response to transmission of a signal via conductor means 61 brings about the advantage that the splice 43 is much less likely to cause disturbances in the operation of the filter rod making machine since the splice advances toward and through successive units of the machine at a less than normal or nominal speed. It has been found that such automatic deceleration of the prime mover 32 often suffices, by itself, to prevent damage to the filter rod making machine, even if no other undertakings are made in response to generation of a signal which is transmitted via conductor means 61.

The conductor means 61 further transmits the signal to the input of the time-delay device 69 which delays such signal for a preselected interval of time prior to transmitting it to the amplifier 71. As a rule, the delay which is determined by the device 69 will be selected in such a way that it corresponds to the interval of time which is required to advance the splice 43 from its predetermined location (namely, from registry with the monitoring device 44 or 144) to the first treating or processing station, i.e., into the passage between the elements 18*a* and 18*d* of the first or foremost tow treating or processing unit 18. When the amplifier 71 transmits a signal, the electromagnets 72, 72*a*, 73, 73*a*, 73*b* and 74 are simultaneously energized or deenergized so as to respectively increase the width of the passage between the elements 18*a*, 18*d* of the first banding device 18, the passage between the elements 22*a*, 22*d* of the second banding device 22, the passage or nip of the rolls 24, the passage or nip of the rolls 26, the passage or nip of the rolls 28, and the passage between the upper and lower sections 29A, 29B of the unit at the plasticizer-applying station 29. As mentioned above, the banding devices 18, 22, the rolls 24, 26, 28 and the unit at the station 29 are normally adjusted in such a way that the width of the corresponding passages corresponds to the maximum acceptable width of the running tow 4 but is normally less than the thickness of a splice 43. Consequently, these passages constitute constrictions for the splice 43 and the corresponding units of the filter rod making machine are likely to be damaged or otherwise adversely affected by the advancement of the splice 43 therethrough or therealong. As also mentioned before, the travel of the splice 43 through passages of normal width could cause a reduction of the speed or complete stoppage of the running tow, or a partial or complete breakage of the tow with attendant substantial losses in the output of the filter rod making machine.

The signal which the detector 51, 57 or 59 transmits via conductor means 61 and which is amplified by the amplifier 71 automatically ensures that the width of the passages between the elements 18*a*, 18*d* of the banding device 18 and the elements 22*a*, 22*d* of the banding device 22, the width of nips of the rolls 24, 26 and 28, and the width of the passage between the upper and lower sections 29A, 29B of the unit at the plasticizer-applying station 29 is increased so as to allow for at least substantially unobstructed transport of the splice 43 toward and into the gathering horn 3. While FIG. 1 shows electromagnetic actuating or condition changing means 72, 72*a*, 73, 73*a*, 73*b* and 74, it is equally within the purview of the invention to resort to other types of actuating means, as long as they are capable of changing the positions of the respective adjustable or displaceable components 18*d*, 22*d*, 24, 26, 28 and 29A. The component 29A can constitute a cover or lid which can be lifted above and away from the lower section 29B of the plasticizer-applying unit at the station 29 to the extent which is needed to allow for at least substantially unobstructed advancement of the splice 43 from the nip of the rolls 28 to the rolls 31 and toward the gathering horn 3.

The delay which is achieved with the time-delay device 69 is preferably variable and is selected in such a way that the signal which is transmitted to the amplifier 71 disappears as soon as the splice 43 advances beyond the passage between the sections 29A and 29B. In selecting the delay which is effected by the device 69, one must take into consideration that the signal which is transmitted via conductor means 61 and amplifier means 62 effects a reduction of the speed of the prime mover 32. A time-delay device 162 upstream of the amplifier 62 ensures that the speed of the prime mover 32 is increased to normal operating speed as soon as the splice 43 advances beyond the passage between the sections 29A, 29B of the unit at the station 29.

The purpose of the time-delay device 63 is to transmit to the servo 66 a delayed signal so that the normally closed valve 68 in the conduit 68*a* opens when the splice 43 (and more particularly that filter rod section 11*a* which contains the splice 43) reaches the ejector nozzle 68*b*. This is desirable because the machine then automatically ejects or expels that filter rod section 11*a* whose characteristics deviate, at least slightly, from the characteristics of other filter rod sections which do not contain welded-together portions of two successive filter tows. In order to be on the safe side, the delay which is determined by the device 63 can be selected in such a way that the nozzle 68*b* ejects a reasonable number of filter rod sections 11*a*, namely, a number which invariably suffices to prevent entry of the splice 43 into the next machine (such as the aforementioned filter tipping machine), even if the knife or knives of the cutoff 12 happen to sever the splice 43 into two or more parts, i.e., even if two or more successive filter rod sections 11*a* contain parts or portions of a splice. The expelled filter rod sections 11*a* constitute waste and can be caused to descend into a suitable collecting receptacle, not shown. It is also within the purview of the invention to adjust the time-delay device 63 in such a way that the nozzle 68*b* begins to eject satisfactory and defective or potentially defective filter rod sections 11*a* as soon as the splice 43 leaves its predetermined position (on the housing 46 or on top of the body member 52) and that the expulsion of filter rod sections 11*a* by the nozzle 68*b* is terminated only when the elapsed interval of ejection evidently and invariably suffices to ensure that the splice 43 (or each part or portion of such splice) has been prevented from advancing beyond the row-forming conveyor 13 together with satisfactory filter rod sections 11*a*.

As described above, the circuitry of the machine which is shown in FIG. 1 is designed in such a way that, once the amplifier 71 transmits a signal, all of the electromagnets 72, 72*a*, 73, 73*a*, 73*b* and 74 are energized or deenergized simultaneously, i.e., the width of the passage between the elements 18*a*, 18*d* increases simultaneously with that of the passage between the elements 22*a*, 22*d*; the width of the nips of the rolls 24, 26, 28 increases simultaneously with an increase in the width of the just discussed passages, and the width of the passages between the sections 29A, 29B increases simultaneously with that of the just discussed nips. However, it is equally possible and feasible to ensure sequential actuation (energization or deenergization) of the electromagnets 72, 72*a*, 73, 73*a*, 73*b* and 74 so that the width of the passage between the elements 18*a*, 18*d* is increased ahead of an increase in width of the passage between the elements 22*a*, 22*d*, that the width of the nip of rolls 24 is increased subsequent to a widening of the passage between the elements 22*a*, 22*d* that the width of the nip of the rolls 26 is increased ahead of a widening of the nip of the rolls 24, and so forth. All that is necessary is to replace the time-delay device 69 with discrete time-delay devices 75*f*, 75*a*, 75*b*, 75*c*, 75*d*, 75*e* which are respectively in series with the electromagnets 72, 72*a*, 73, 73*a*, 73*b* and 74. Since the time-delay devices 75*a* to 75*f* constitute a desirable but nevertheless optional modification of the circuitry, they are indicated in FIG. 1 by broken lines. If utilized, the time-delay device 75*f* is designed in such a way that it causes the width of the passage between the elements 18*a*, 18*d* of the first or foremost banding device 18 to increase for a preferably short interval of time immediately or shortly before the splice 43 reaches the banding device 18. The same preferably holds true for the time-delay devices 75*a*, 75*b*, 75*c*, 75*d* and 75*e*, i.e., each of these devices can energize or deenergize the respective electromagnet at a different time (with a different delay following the start of movement of the splice 43 away from its normal or predetermined position on the housing 46 or member 52). The just discussed modification exhibits the important advantage that the number of unsatisfactory or presumably unsatisfactory filter rod sections 11*a* is reduced to a minimum, i.e., the machine is much less likely to produce defective filter rod sections in addition to that filter rod section or those filter rod sections which contain the entire splice 43 or portions of the splice because the machine is much less likely to turn out defective filter rod sections when the width of the aforementioned passages is normal rather than wide enough to allow for unimpeded passage of the splice. In other words, the machine is much less likely to produce a substantial number of rejects if the width of the various passages is increased only and alone during the interval of travel of a splice therethrough.

The circuitry which is shown in FIG. 1 is designed to reduce the speed of the main prime mover 32 as well as to effect delayed ejection of a certain number of filter rod sections 11*a* and delayed energization of deenergization of electromagnets 72, 72*a*, 73, 73*a*, 73*b* and 74. It is also within the purview of the invention to omit the electromagnets 72, 72*a*, 73, 73*a*, 73*b* and 74, i.e., to simply reduce the speed of the tow during travel of a splice 43 toward the drum-shaped conveyor 13. This often suffices to reduce the likelihood of damage to the machine, the making of excessive numbers of defective filter rod sections and/or breakage of the running tow because, while advancing at a relatively low speed, a splice (even a relatively thick splice) is much more likely to readily pass through the banding devices 18, 22, through the nips of the rolls 24, 26, 28 and through the passage between the sections 29A, 29B even without any widening of the passages. The same holds true for the provision of the time-delay device 63, amplifier 64, servo 66, valve 68, source 67, conduit 67*a* and ejector nozzle 68*b*, i.e., such parts can be used alone (without any deceleration of the main prime mover 32 and by omitting the electromagnets 72, etc.), in combination with the means for decelerating the main prime mover 32, or in combination with the electromagnets 72, etc., amplifier 71 and time-delay device 69. By the same token, one can resort exclusively to the parts 69, 71, 72, 72*a*, 73, 73*a*, 73*b*, 74; to a combination of such parts with means for automatically decelerating the prime mover 32; or to a combination of parts 69, 71, 72, etc. with the parts 63, 64, 66, 67, 68, 68*a* and 68*b*. It has been found that the speed of the main prime mover 32 can remain unchanged (i.e., that such speed need not be reduced) if the width of the aforementioned passages is increased in time for the advancement of a splice therethrough.

An important advantage of the improved method and machine is that the absence or lack of homogeneousness in certain portions of the composite tow which is advanced through the machine (namely, in portions including the splice 43) cannot adversely influence the operation of the machine, even of a machine which is of a recent or very recent design and thus turns out extremely large quantities of filter rod sections per unit of time. As explained above, intermittent presence of inhomogeneous portions of tow in the machine can be compensated for in one or more ways, such as by expelling the corresponding filter rod sections 11*a* from the path for satisfactory filter rod sections, by reducing the speed of the prime mover 32 and/or by increasing the width of one or more passages defined by the units through which the tow advances on its way toward the conveyor 13. All this can be accomplished by the simple expedient of detecting the advancement of the splice between two interconnected tows toward the first or foremost treating or processing unit and generating a signal which is utilized to set in operation one or more actuating or condition changing means for the respective unit or units of the machine. The provision of means for yieldably holding the splice at a predetermined location upstream of the first or foremost treating or processing unit is advisable and advantageous because, as a rule, the location of the splice is not fixed since each bale contains a supply of looped tow so that the point of withdrawal of successive increments of the tow from the respective supply moves back and forth and could initiate premature movement of the splice from its predetermined location, especially shortly prior to expiry of the running tow. The provision of means for releasably holding the splice renders it necessary to provide for the tow guide means between the source of supply of running tow and the first or foremost treating or processing unit of the machine. Moreover, such holding means ensures the generation of a predictable and clearly defined signal at the right moment, namely, when the supply of running tow has expired and the splice is compelled to advance toward the first or foremost treating or processing unit. In other words, the signal is always generated a predetermined interval of time ahead of arrival of the splice at the first banding device 18.

An additional important advantage of the improved method and machine is that the machine requires less maintenance and less supervision than heretofore known machines. Thus, the signal which denotes that the splice 43 is in motion toward the first or foremost treating or processing unit is generated in a fully automatic way so that the supply of running tow need not be observed by the attendants and the speed of the prime mover need not be reduced by hand. The same holds true for the segregation of filter rod sections which contain or are likely to contain portions of a splice and/or for enlargement or widening of the passages through which the splice advances toward the conveyor 13.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of making filter rod sections for incorporation into smokers' products, comprising the steps of establishing and maintaining first and second sources which respectively contain first and second tows consisting of filamentary filter material and each having a leader and a trailing end; subjecting the first tow to a plurality of treatments including advancing the first tow along a predetermined path and processing the first tow in several portions of said path; making between the trailing end of the first tow and the leader of the second tow a splice which is set in motion on expiry of the first tow and the resulting advancement of the second tow along said path; and altering at least one of said treatments in automatic response to movement of the splice.

2. The method of claim 1, further comprising the steps of maintaining the splice in a predetermined position which the splice abandons on expiry of the first tow, generating a signal in response to movement of the splice beyond said position, and utilizing said signal to alter said one treatment.

3. The method of claim 1, wherein said one treatment includes advancing the tow along said path.

4. The method of claim 1, wherein said one treatment includes banding the tow in said path.

5. The method of claim 1, wherein said one treatment includes stretching the filaments of the tow in said path.

6. The method of claim 1, wherein said one treatment includes applying atomized plasticizer to the filaments of the tow in said path.

7. The method of claim 1, wherein said one treatment includes segregating from said path those portions of the tow which contain the splice.

8. The method of claim 1, wherein said processing step includes converting the tow and a web of wrapping material into a continuous rod and subdividing the rod into a succession of discrete filter rod sections, said one treatment including segregating from said succession all such filter rod sections which contain portions of the splice.

9. The method of claim 1, wherein said advancing step includes transporting the tow at at least one first speed and said one treatment includes reducing said first speed to a lower second speed, at least during a portion of the interval which is taken up for advancement of the splice along said path.

10. The method of claim 1, wherein said path has at least one portion of variable width and said one treatment includes increasing the width of said one path portion so as to allow for at least substantially unobstructed passage of the splice therethrough.

11. The method of claim 1, wherein said path has several portions of variable width and said one treatment includes increasing the width of each such portion of variable width so as to allow for at least substantially unobstructed passage of the splice therethrough.

12. The method of claim 1, wherein said processing step involves treating the tow at each of a series of successive stations adjacent to successive portions of said path, and further comprising the steps of maintaining the splice in a predetermined position which the splice abandons on expiry of the first tow, generating a signal in response to movement of the splice away from said position, and utilizing said signal to alter said one treatment.

13. The method of claim 12, wherein said utilizing step includes altering the treatment of the tow seriatim at successive stations in at least substantial synchronism with advancement of the splice from said predetermined position toward the respective portions of said path.

14. The method of claim 12, further comprising the step of maintaining said signal during the interval of advancement of the splice from said predetermined position to the last of said stations.

15. The method of claim 12, wherein said utilizing step further comprises the step of reducing the speed at which the tow advances along said path during movement of the splice from said predetermined position to the last of said stations.

16. In a machine for making filter rod sections for incorporation into smokers' products, the combination of first and second sources which respectively contain first and second tows consisting of filamentary filter material and each having a leader and a trailing end, the leader of the second tow and the trailing end of the first tow forming a splice; a plurality of tow treating units including means for advancing the first tow along a predetermined path and additional units for treating the tow in said path; monitoring means for generating a signal when the splice between the first and second tows is set in motion on expiry of the first tow; and means for changing the condition of at least one of said units in response to said signal.

17. The combination of claim 16, wherein said additional treating units include a foremost treating unit, as considered in the direction of advancement of the tow along said path, said monitoring means being located ahead of said foremost additional unit.

18. The combination of claim 16, wherein said additional treating units include means for gathering the running tow into a filler, means draping the filler into a web of wrapping material to thus form a continuous filter rod, and means for subdividing the continuous filter rod into filter rod sections of predetermined length.

19. The combination of claim 16, further comprising means for holding the splice between the tows at a predetermined location which the splice abandons on expiry of the first tow, said monitoring means including detector means for generating said signal in response to advancement of the splice beyond said predetermined location.

20. The combination of claim 19, wherein said holding means includes means for yieldably retaining the splice at said predetermined location.

21. The combination of claim 16, wherein said monitoring means includes optoelectrical transducer means.

22. The combination of claim 16, further comprising means for holding the splice by suction at a predetermined location which the splice abandons on expiry of the first tow, said monitoring means including detector means for generating said signal in response to advancement of the splice beyond said holding means.

23. The combination of claim 22, wherein said holding means comprises a support for the splice and said support having at least one suction port which releasably attracts the splice to said support.

24. The combination of claim 23, further comprising suction generating means connected with said support and arranged to draw air from said suction port.

25. The combination of claim 23, wherein said detector means includes a pressure-sensitive detector which is arranged to monitor the pressure in said suction port.

26. The combination of claim 16, further comprising mechanical holding means for yieldably retaining the splice at a predetermined location, said monitoring means including detector means for generating said signal in response to advancement of the splice beyond said location.

27. The combination of claim 26, wherein said detector means includes electric switch means actuatable by said mechanical holding means.

28. The combination of claim 27, wherein said mechanical holding means includes a trip movable from a first to a second position in response to advancement of the splice beyond said location to thereby actuate said switch means.

29. The combination of claim 16, wherein said one unit defines in said path a passage of variable width and said changing means includes means for varying the width of said passage in response to said signal.

30. The combination of claim 29, wherein several additional units define in said path passages of variable width and said changing means includes means for varying the width of said passages in response to said signal.

31. The combination of claim 16, wherein said advancing means includes variable-speed drive means for the tow in said path and said changing means includes means for varying the speed of said drive means in response to said signal.

32. The combination of claim 31, wherein said changing means includes means for reducing the speed of said drive means.

33. The combination of claim 16, wherein said additional units include means for converting the tow into a rod-like filler, means for draping the filler into a web of wrapping material to thus form a continuous filter rod, means for subdividing the rod into a succession of filter rod sections, and means for transporting the filter rod sections along a predetermined portion of said path, said one unit including a normally idle ejecting device for filter rod sections in said predetermined portion of said path and said changing means comprising means for activating said ejecting device in response to said signal.

34. The combination of claim 33, wherein said ejecting device includes a nozzle, a source of compressed gaseous fluid, conduit means for connecting said source with said nozzle and normally closed valve means in said conduit means, said activating means comprising means for opening said valve means.

35. The combination of claim 16, further comprising means for delaying the application of said signal to said changing means to account for advancement of the splice toward said one unit.

36. The combination of claim 35, wherein said delaying means is operative to delay the signal so that said changing means changes the condition of said one unit only immediately prior to and during advancement of the splice through the respective portion of said path.

37. The combination of claim 36, wherein said changing means further comprises means for reducing the speed of the tow in said path during advancement of the splice through that portion of the path which is adjacent to said one unit.

38. The combination of claim 16, wherein said changing means comprises at least one electromagnet.

* * * * *